United States Patent [19]

Warabi et al.

[11] 4,394,554

[45] Jul. 19, 1983

[54] VACUUM CIRCUIT INTERRUPTER

[75] Inventors: Junichi Warabi, Shizuoka; Shinzo Sakuma, Yokohama; Hidemi Kawaguchi; Yukio Kobari, both of Tokyo, all of Japan

[73] Assignee: Kabushiki Kaisha Meidensha, Japan

[21] Appl. No.: 257,853

[22] Filed: Apr. 27, 1981

[30] Foreign Application Priority Data

May 6, 1980 [JP] Japan ..... 55-59675

[51] Int. Cl.[3] ..... H01H 33/66

[52] U.S. Cl. ..... 200/144 B

[58] Field of Search ..... 200/144 B, 144 C

[56] References Cited

U.S. PATENT DOCUMENTS

| | | | |
|---|---|---|---|
| 2,121,180 | 6/1938 | Vatter | 200/144 B |
| 3,231,704 | 1/1966 | Jacobs | 200/144 B |
| 3,250,880 | 5/1966 | Jennings | 200/144 B |
| 4,077,114 | 3/1978 | Sakuma | 200/144 B X |
| 4,229,631 | 10/1980 | Arakawa et al. | 200/144 B |

FOREIGN PATENT DOCUMENTS

| | | | |
|---|---|---|---|
| 52-124267 | 9/1979 | Japan | 200/144 B |

*Primary Examiner*—Donald A. Griffin

*Attorney, Agent, or Firm*—McGlew and Tuttle

[57] ABSTRACT

A vacuum interrupter for electric power having a vacuum vessel into which a pair of electrode holders each having an electrode contact brazed to the end thereof are in contact with each other when the device is closed and are separated from each other when the device is open. The vacuum vessel comprises: (a) an insulating envelope made of ceramic or crystallized glass having a metallized layer at each end thereof; (b) a first metallic end plate made of copper to the periphery of which one metallized layer of the insulating envelope is brazed; (c) a second metallic end plate made of copper to the periphery of which the other metallized layer of the insulating envelope is brazed; (d) an arc shielding member located within the insulating envelope so as to surround the pair of electrode contacts and be brazed to the second metallic end plate at one end thereof; and (e) a bellows located within the arc shielding member brazed to the electrode holder at one end thereof and to the second metallic end plate at the other end thereof. Both the first and second metallic end plates are made of copper, and are annealed during the brazing operation so that they are easily deformed plastically, whereby thermal stress generated between the end plates and the insulating envelope is absorbed into these plastically deformable end plates and the insulating envelope and brazed joints are not destroyed.

33 Claims, 24 Drawing Figures

VACUUM CIRCUIT INTERRUPTER

BACKGROUND OF THE INVENTION

1. Field of the Invention

The present invention relates to a vacuum interrupter having a highly evacuated vessel containing a pair of electrode contacts which are in contact with each other when the vacuum interrupter is closed and with one of the electrode contacts being separated from the other electrode contact when the vacuum interrupter is open, an arc shielding member surrounding both the electrode contacts so as to prevent generation of metal vapor due to arcing between the electrode contacts during the opening and closing operation, and a cylindrical insulating envelope with metallic end plates located at the ends of the insulating envelope in which the pair of electrode contacts and the arc shielding member are contained in a highly evacuated state.

2. Statement of the Prior Art

A conventional vacuum interrupter comprises:

(1) an insulating envelope having a metallized portion covered by a metal suitable for hermetically brazing each of upper and lower ends thereof;

(2) a first metallic end plate brazed to the upper end of the insulating envelope;

(3) a second metallic end plate brazed to the lower end of the insulating envelope;

(the insulating envelope, first metallic end plate, and second metallic end plate constituting a vacuum vessel)

(4) a stationary electrode holder extending through the center of the first metallic end plate and brazed thereat to the first metallic end plate;

(5) a movable electrode holder extending through the center of the second metallic end plate so as to move vertically with one end thereof brazed to one end of a bellows whose other end is brazed to the center of the second metallic end plate;

(6) a stationary electrode contact brazed to the inner end of the stationary electrode holder;

(7) a movable electrode contact brazed to the inner end of the movable electrode holder; and (8) a cylindrical arc shielding member extended so as to surround both the stationary and movable electrode contacts, one end thereof being brazed to the second metallic end plate.

In such a conventional vacuum interrupter, the insulating envelope is formed of ceramics or crystallized glass (which is also called Devitro ceramics, glass ceramics, or devitrified glass). Such a material has a higher mechanical strength and superior heat resistance of 600° C. or more. The end plates to be brazed to the insulating envelope have a thermal expansion coefficient different from that of the insulating envelope. After brazing a residual stress is, therefore, generated so that the insulating envelope may be destroyed since its mechanical strength is weaker than that of the end plates.

To cope with the problem described above, each end plate is formed of an alloy of iron and nickel (abbreviated Fe-Ni alloy) or iron, nickel, and cobalt (abbreviated Fe-Ni-Co alloy). Such alloys have substantially the same thermal expansion coefficient as ceramic or crystallized glass. A brazing alloy of 72% of silver and 28% of copper equal in solidus and liquidus temperature is frequently used as the brazing agent. If a brazing alloy including a component of silver is used, the brazing alloy penetrates and diffuses into the Fe-Ni alloy or Fe-Ni-Co alloy of the end plates to cause cracking, so that the reliability of the hermetic seal is lowered in the vacuum interrupter. Consequently, brazing alloys including silver cannot be used. Fe-Ni and Fe-Ni-Co alloys are magnetic materials and each end plate is positioned perpendicularly with respect to each electrode holder through which a current passes so that the magnetic flux passes perpendicularly through each end plate and the amount of induced flux is increased and a large eddy current is developed in each end plate. Consequently, each end plate exhibits a considerable temperature rise due to eddy current losses. This is particularly noticeable in the case of a vacuum interrupter with a large current rating. Furthermore, the use of cobalt is expensive and therefore an Fe-Ni-Co alloy is also expensive. As compared with the Fe-Ni-Co alloy, the Fe-Ni alloy is inexpensive but the difference of thermal expansion coefficient from that of ceramics or crystallized glass is relatively large and residual stresses will be easily generated.

SUMMARY OF THE INVENTION

With the above-described problems in mind, it is an object of this invention to provide a less expensive vacuum interrupter for electric power, which avoids large temperature rises in the metallic end plates and avoids failure of the vacuum vessel of the vacuum interrupter when using a brazing metal including an alloy of silver and another brazing metal.

To achieve the present invention, there is provided a vacuum interrupter having a vacuum vessel comprising: (a) a first metallic end plate made of corrosion-free copper at the edge thereof, brazed to one metallized end of an insulating envelope; (b) a second metallic end plate also made of corrosion-free copper at the edge thereof, brazed to the other metallized end of the insulating envelope; (c) a stationary electrode holder extending through the first metallic end plate and having a stationary electrode contact brazed at the inner end thereof; (d) a movable electrode holder extending through the second metallic end plate so as to move in a given direction and having a movable electrode contact at the inner end thereof; (e) a bellows made of an iron and chromium alloy, with one end brazed to the movable electrode holder and the other end to the second metallic end plate; and (f) an arc shielding member made of the iron and chronium alloy or of copper, located within the insulating envelope so as to surround both the stationary and movable electrode contacts, one end brazed to the second metallic end plate.

BRIEF DESCRIPTION OF THE DRAWINGS

All of the objects, features, and advantages of the present invention will be understood from a reading of the specification taken with the claims and drawings in which:

DESCRIPTION OF THE PREFERRED EMBODIMENTS

Figure 1:
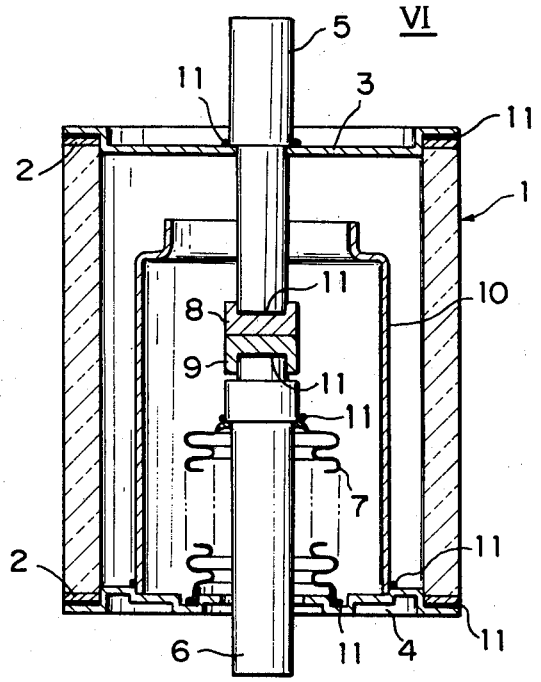
FIG.1 PRIOR ART
FIG. 1 shows an axial cross-sectional view of a conventional interrupter in the closed state.

Referring first to FIG. 1, a conventional vacuum interrupter VI is shown including:

(a) an insulating envelope 1 having a metallized layer 2 at each end thereof, the metallized layer 2 being previously metallized on each end with a suitable metal to provide a hermetic seal after brazing;

(b) a first metallic end plate 3 located on the upper end of the insulating envelope 1 brazed to the corresponding metallized layer 2 of the insulating envelope 1 (all brazing being shown at numerals 11);

(c) a second metallic end plate 4 located on the lower end of the insulating envelope 1, brazed to the corresponding metallized layer 2 of the insulating envelope 1;

(d) a stationary electrode holder 5 having a portion brazed to a central hole in the first metallic end plate 3 and extending vertically into the vacuum vessel formed by the first and second metallic end plates 3 and 4 and insulating envelope 1;

(e) a movable electrode holder 6 having an upper end brazed to a bellows 7, which bellows is brazed to a central hole in the second metallic end plate 4 and extends vertically into the vacuum vessel;

(f) a stationary electrode contact 8 brazed to the inner end of the stationary electrode holder 5;

(g) a movable electrode contact 9 brazed to the inner end of the movable electrode holder 6; and (h) a cylindrical arc shielding member 10 located within the vacuum vessel so as to surround the stationary and movable electrode contacts 8 and 9.

In FIG. 1, each numeral 11 indicates in a dotted marks or solid line, denotes the places where a brazing is performed to provide hermetic seals and form the vacuum interrupter.

In such a vacuum interrupter as described above, the insulating envelope 1 is formed of ceramic material or devitro ceramics (hereinafter referred to as a crystallized glass) because of its greater mechanical strength and superior heat resistance of 600° C. or more. If, however, the thermal expansion coefficient of the end plates 3 and 4 is considerably different from that of the material used for the insulating envelope 1, a residual stress is generated so that the insulating envelope 1 may break since the mechanical strength of the insulating envelope 1 is weaker than that of the end plates 3 and 4. Therefore, the end plates 3 and 4 are made of an alloy of iron and nickel (hereinafter referred to as an Fe-Ni alloy) or of iron, nickel, and cobalt (hereinafter referred to as an Fe-Ni-Co alloy). Although a brazing metal is used consisting of 72% silver and 28% copper equal in solidus liquidus temperature and which is easy to braze, a brazing metal including silver penetrates and diffuses into the Fe-Ni or Fe-Ni-Co alloy used for these metallic end plates. Consequently, the hermetic reliability of the vacuum interrupter is reduced. For this reason, it is inconveniently impossible to use such a brazing metal including silver.

Since Fe-Ni and Fe-Ni-Co alloys are magnetic materials and the end plates 3 and 4 are disposed perpendicularly with respect to the corresponding electrode holders 5 and 6, magnetic flux passes perpendicularly into the end plates 3 and 4 increasing the induced magnetic flux. Consequently, each end plate 3 and 4 develops a large amount of eddy current and an abrupt rise in temperature arises due the eddy currents. This problem becomes more noticeable as the current rating of the vacuum interrupter increases. Furthermore, Fe-Ni-Co alloy is expensive due to the high price of cobalt. As compared to a Fe-Ni-Co alloy, Fe-Ni alloy is inexpensive but the difference of the thermal expansion coefficient from ceramics or crystallized glass is relatively large so that residual stresses in the ceramics or crystallized glass are generated easily.

With reference to the drawings of FIGS. 2 through 24, preferred embodiments of the vacuum interrupter in accordance with the principles of the present invention will be described hereinafter.

Figure 3:
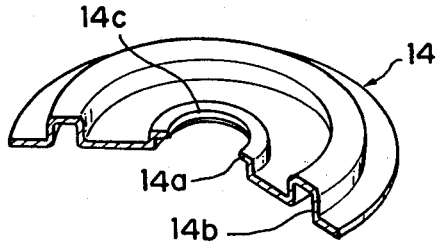
FIG. 3 shows a vertically sectioned perspective view of the end plate located around the movable electrode holder of the vacuum interrupter of the first preferred embodiment shown in FIG. 2.
Figure 2:
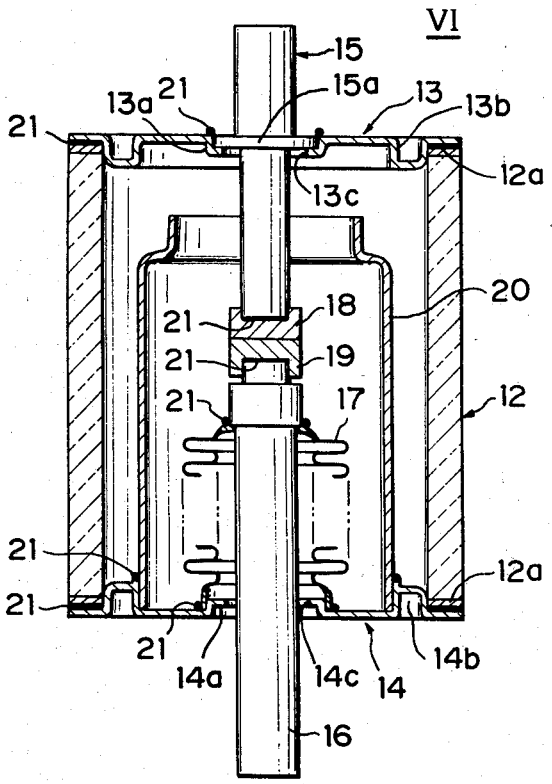
FIG. 2 shows an axial cross sectional view of a vacuum interrupter of a first preferred embodiment in accordance with the principles of the present invention with the electrode contacts in their closed position.

FIG. 2 and 3 show a vacuum interrupter of the first preferred embodiment according to the present invention.

In FIG. 2, numeral 12 denotes an insulating envelope made of the same material as described with FIG. 1, with upper and lower ends which have metallized layers 12*a* that are made of a metal which is suitable for forming a hermetical seal by brazing. The temperature range within which vacuum brazing is possible is from 600° C. to 1050° C. or more (hereinafter the contents of brackets indicate the possible vacuum brazing temperature range described above). Numerals 13 and 14 denote a first and second metallic end plate each brazed to the corresponding end of the insulating envelope 12. Each end plate 13 and 14 is formed of corrosion-free copper (600° C. to 1200° C. or more). In addition, the first metallic end plate 13 has substantially the same profile as the second metallic end plate 14; that is, an inwardly bent recess 13*a* or 14*a* at the center of each end plate 13 and 14 having a hole 13*c* or 14*c* in each recess 13*a* or 14*a* respectively, and another inwardly bent recess 13*b* or 14*b* near the edge of each end plate 13 or 14 attached to each metallized layer 21 of the insulating envelope 12. It will be seen that the end plates 13 and 14 and the insulating envelope 12 constitute a vacuum vessel. Numerals 15 and 16 denote a stationary electrode holder and movable electrode holder, respectively. These holders 15 and 16 are made of corrosion-free copper Cu. The stationary electrode holder 15 is inserted through the hole 13*c* and brazed to the recess 13*a* of the stationary end plate 13 by a flange 15*a* of the stationary electrode holder 15. The movable electrode holder 16 is inserted through the hole 14*c* of the second metallic end plate 14 so as to move in its axial direction. Numeral 17 denotes a bellows, an upper end of which is connected to the upper part of the movable electrode holder 16 by brazing. The lower end of bellows 17 is connected to the edge of the recess 14*a* of the second metallic end plate 14 by brazing. Numerals 18 and 19 denote a stationary electrode contact and a movable electrode contact respectively, brazed to the inner end of the stationary electrode holder 15 and to the inner end of the movable electrode holder 16, respectively. Each electrode contact 18 and 19 is formed of a copper alloy (600° C. to 1050° C. or more), a silver alloy (600° C. to 900° C. or more), or a beryllium alloy (600° C. to 1200° C. or more). Numeral 20 denotes an arc shielding member made of an alloy of iron and chromium (hereinafter referred to as a Fe-Cr alloy), e.g., stainless steel (900° C. to 1200° C. or more) or copper (600° C. to 1050° C. or more). Each numeral 21 denotes a brazed joint. It will be appreciated from FIG. 2 that the brazed joint 21 using the brazing material is sandwiched between each metallized layer 12*a* of the insulating envelope 12 and metallic end plate 13 and 14. It should be noted that the lower limit of the brazing temperature range is 600° C. because of the limitations of the vacuum brazing material used and the lowest temperature in the deoxidation of the base metal. Furthermore, it should be noted that the higher limit of the brazing temperature range is, e.g., 1200° C. or more, since a value of more than the higher limit, e.g., more than 1200° C. is possible for brazing but in actual practice, the value of the indicated higher temperature limit is assumed to be the higher limit of the brazing temperature range.

In the vacuum interrupter described above, the end plates 13 and 14 are formed of copper for the following reason:

Whereas the thermal expansion coefficient of copper is $16.7\times10^{-6}$/°C., that of the ceramics or crystallized glass forming the insulating envelope 12 is from 7 to $9\times10^{-6}$/°C. (the thermal expansion coefficient of the aluminous ceramics used commonly is approximately $8\times10^{-6}$/°C. and of the Fe-Ni and Fe-Ni-Co alloys are from 4.5 to $5.5\times10^{-6}$/°C. Therefore, if the insulating envelope 12 is brazed to the end plates 13 and 14, residual stress may be developed after brazing due to the difference between the thermal expansion coefficients so that the insulating envelope 12 may break.

When the insulating envelope 12 and the first and second metallic end plates 13 and 14 are, however, brazed under a vacuum pressure below $10^{-4}$ Torr and at a temperature ranging from 600° C. to 1050° C., it has been indicated that a hermetic seal can be performed by brazing without failure, the mechanical life of the closing and opening operations is 0.5 million or more times, and that ambient temperatures from −40° C. to 100° C. can be sufficiently endured. The reason for this is that the end plates are annealed during the brazing operation.

Figure 4:
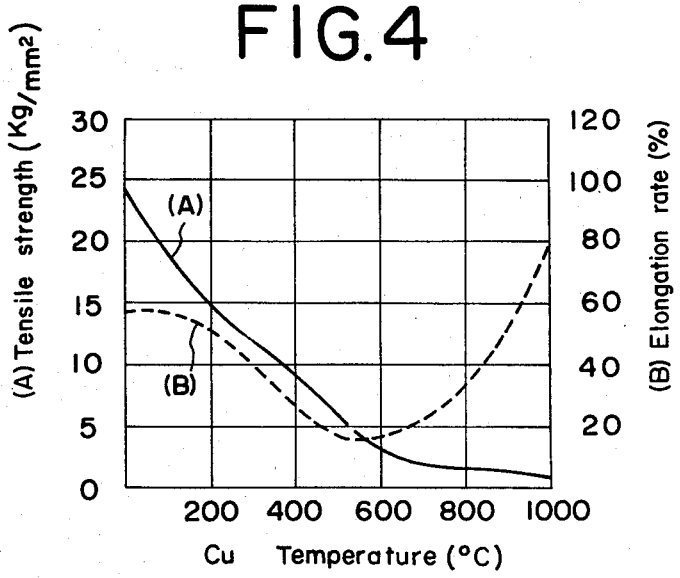
FIG. 4 shows a graph representing the relationship between the temperature and the tensile strength and elongation rate of annealed copper.

FIG. 4 shows the relationship between the temperature, tensile strength, and elongation of annealed copper. The tensile strength decreases as the temperature rises, whereas the elongation rate increases as the temperature rises. Therefore, annealed copper easily deforms plastically. After the brazing at a temperature from 600° C. to 1050° C., the brazing metal is solidified to form a hermetic seal between the insulating envelope 12 and each end plate 13 and 14. When the temperature decreases, the end plates 13 and 14 deform plastically so that thermal stress between each end plate 13 and 14 and the insulating envelope 12 is not developed and neither the insulating envelope 12 nor the brazed joints 21 are broken. When the temperature further decreases and drops below approximately 200° C., each end plate 13 and 14 is transformed from plastic deformation to elastic deformation so that the annealed copper of each end plate 13 and 14 takes the same state as under a hardened treatment, and increases its mechanical strength. If the brazing between the insulating envelope 12 and each plate 13 and 14 is performed under an reducing atmosphere, such as hydrogen, the brazing is further facilitated. In this case, a getter material for adsorbing hydrogen is required to be installed within the insulating envelope 12. It will be seen that each end plate 13 and 14 can be manufactured easily by pressing. It will also be seen that two recesses 13*a* and 13*b* or 14*a* and 14*b* are provided in each end plate 13 and 14 so that an increase of axial mechanical strength and a relaxation of diametrical thermal stress and mechanical stress can be achieved.

When the vacuum interrupter described above is manufactured, the brazing temperature is required to be 900° C. or more since the bellows 17 (and the arc shielding member 20) is formed of a Fe-Cr alloy. In this case, if each stationary and movable electrode contact 18 and 19 is formed of a copper alloy or beryllium alloy, a single brazing operation permits the brazing of all the members of the vacuum interrupter under a vacuum pressure below $10^{-4}$ Torr and at a temperature from 900° C. to 1050° C.

As an alternative, the brazing of the bellows 17 and the arc shielding member 20 with other corresponding members is performed in a hydrogen atmosphere or under a vacuum pressure below $10^{-4}$ Torr at a temperature ranging from 900° C. to 1050° C. After inspection of each brazed joint, brazing with other corresponding members may be performed at a temperature ranging from 600° C. to 900° C. and under a vacuum pressure below $10^{-4}$ Torr.

Figure 5:
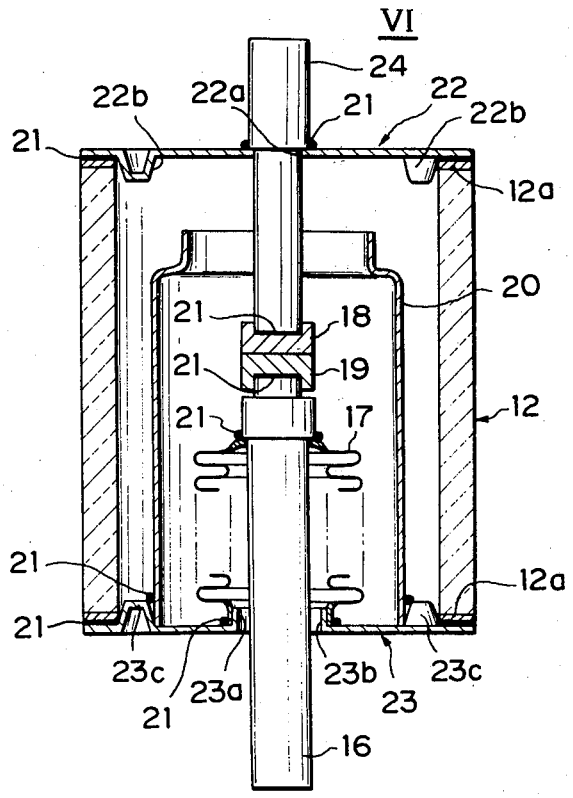
FIG. 5 shows an axial cross-sectional view of a vacuum interrupter of a second preferred embodiment in accordance with the principles of the present invention with the electrode contacts in their closed position.
Figure 6:
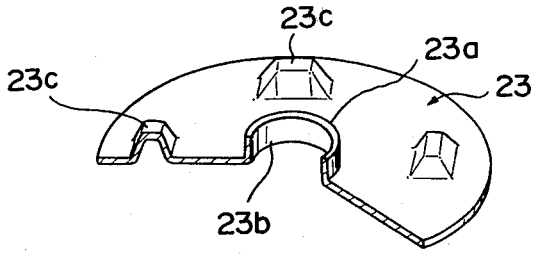
FIG. 6 shows an axial cross-sectional view of the end plate located around the movable electrode holder of the vacuum interrupter of the second preferred embodiment shown in FIG. 5.

FIGS. 5 and 6 show a vacuum interrupter of a second preferred embodiment according to the present invention.

Numerals 22 and 23 denote first and second metallic end plates made of corrosion-free copper, respectively. The first metallic end plate 22 is provided with a hole 22*a* at its center through which the stationary electrode holder 24 is inserted and to which the holder 24 is brazed as shown by numeral 21 and a plurality of recesses 22*b* are provided on the first end plate 22 with a given angular distance to engage with the circumference of the insulating envelope 12. The second metallic end plate 23 is provided with a hole 23*b* at its center through which the movable electrode holder 16 is inserted, a lip 23*a* bending inwardly from the hole 23*b* to which the bellows 17 is brazed, and a plurality of recesses 23*c* with a given angular distance around the circumference thereof to engage with the insulating envelope 12. The stationary electrode holder 24 is made of corrosion-free copper. Other constructions, actions and manufacturing methods are the same as in the first preferred embodiment described hereinbefore.

Figure 7:
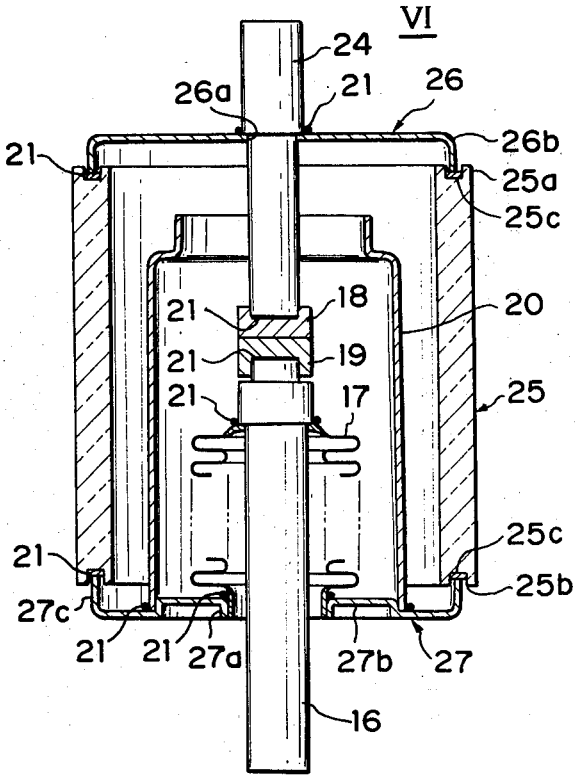
FIG. 7 shows an axial cross-sectional view of a vacuum interrupter of a third preferred embodiment in accordance with the principles of the present invention with the electrode contacts in their closed position.
Figure 8:
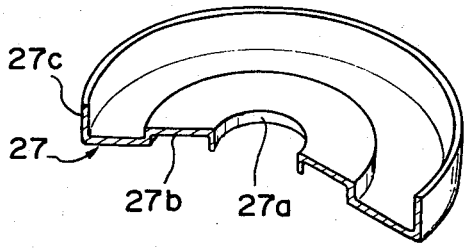
FIG. 8 shows a vertically sectioned perspective view of the second metallic end plate located around the movable electrode holder of the vacuum interrupter of the third preferred embodiment shown in FIG. 7.

FIGS. 7 and 8 show a vacuum interrupter of a third preferred embodiment according to the present invention. Numeral 25 denotes an insulating envelope made of ceramics or crystallized glass. The insulating envelope 25 is provided with a circular groove 25*a* and 25*b* at each end thereof where a metallized layer 25*c* is formed; with the first groove 25*a* at the upper end and the second groove 25*b* at the lower end. Numerals 26 and 27 denote a first metallic end plate and second metallic end plate, respectively. At the center of the first metallic end plate 26 is a hole 26*a* through which the stationary electrode holder 24 is inserted into the vacuum vessel and to which the holder 24 is brazed as indicated by numeral 21. A lip 26*b*, which is inwardly bent at substantially a right angle, is brazed into the circular groove 25*a* and to the metallized layer 25*c* of the insulating envelope 25. In addition, the second metallic end plate 27 is provided with a hole 27*a* at the center thereof to which the bellows 17 is fitted and brazed and through which the movable electrode holder 16 is inserted so as to move in its axial direction. A circular recess 27*b* is formed along the periphery of the hole 27*a* so as to be fitted and brazed to the circular end indicated by numeral 21, of the arc shielding member 20. A lip 27*c*, which is bent inward is formed at the periphery of the second end plate 27 so as to be fitted and brazed in the circular groove 25*b* to the metallized layer 25*c* of the insulating envelope 25. Since in the vacuum interrupter of this construction the edge of the first and second metallic end plates 26 and 27 is brazed to the circular grooves 25*a* and 25*b* respectively, the voltage withstanding characteristics of the vacuum circuit interrupter is improved during an open state of the electrode contacts and plastic deformation of the first and second metallic end plates 26 and 27 is made easier. The other constructions, actions, and manufacturing methods are substantially the same as those in the preferred embodiments described above.

Figure 9:
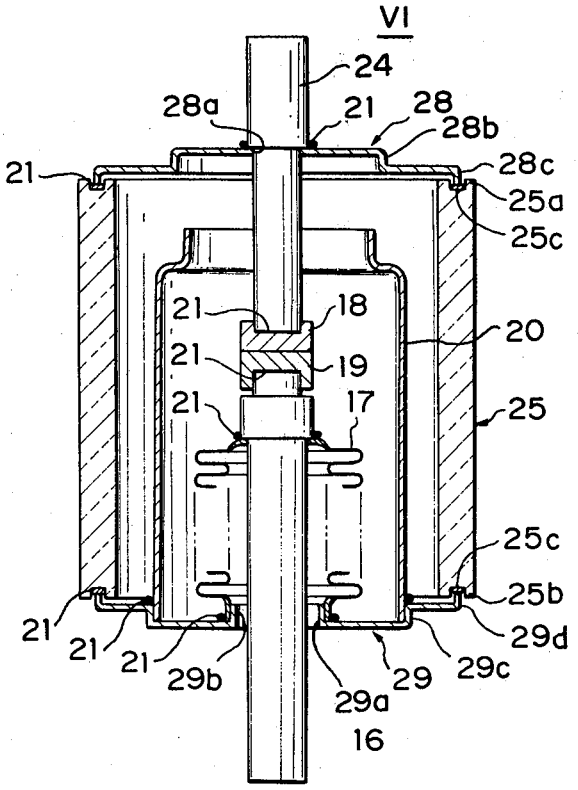
FIG. 9 shows an axial cross-sectional view of a vacuum interrupter of a fourth preferred embodiment in accordance with the principles of the present invention with the electrode contacts in their closed position.

FIG. 9 shows a fourth preferred embodiment according to the present invention. In FIG. 9, numeral 28 and 29 denote a first and second metallic end plate, respectively, made of corrosion-free copper. The first metallic end plate 28 is provided with a hole 28*a* at the center thereof through which the stationary electrode holder 24 is inserted and to which the holder 24 is brazed as indicated by numeral 21. The second end plate 29 has a hole 29*a* at the center thereof through which the movable electrode holder 16 is inserted so as to be able to move in its axial direction, a lip 29*b* at the center thereof bent inward to be brazed with the lower end of the bellows 17, a step 29*c* to which the lower end of the arc shielding member 20 is brazed, and a lip 29*d* bent inward along the periphery thereof so as to be fitted and brazed to the groove 25*b* provided at the lower end of the insulating envelope 25. In this vacuum interrupter VI, the steps 28*b* and 29*c* are provided in each end plate 28 and 29 respectively so that a reinforcement of axial mechanical strength and relief of radial stress can be achieved. The constructions, actions, and manufacturing methods are substantially the same as those in the other preferred embodiments described before.

Figure 11:
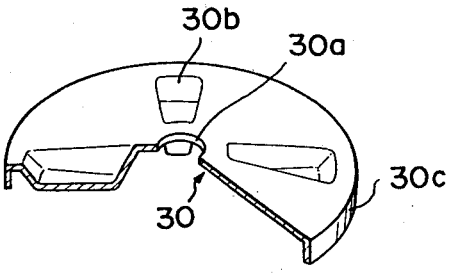
FIG. 11 shows a partially sectioned perspective view of the first metallic end plate located around the stationary electrode holder of the vacuum interrupter of the fifth preferred embodiment shown in FIG. 10.
Figure 10:
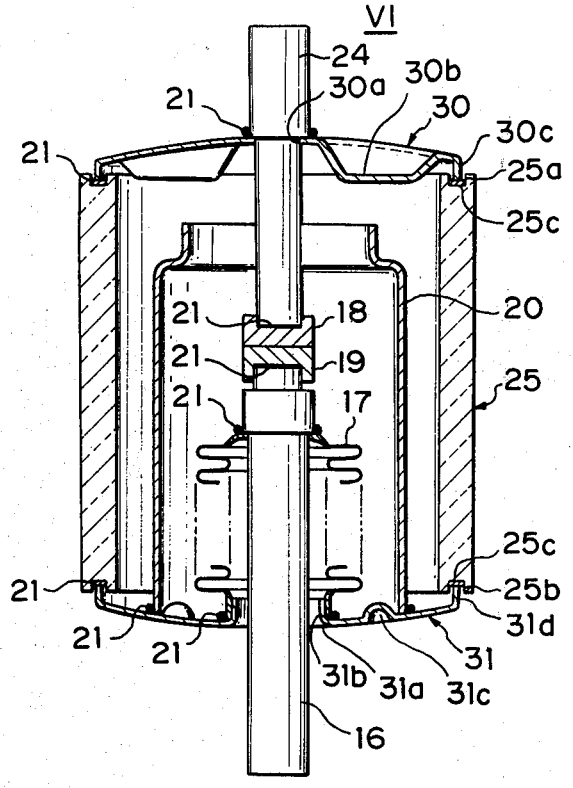
FIG. 10 shows an axial cross-sectional view of a vacuum interrupter of a fifth preferred embodiment in accordance with the principles of the present invention with the electrode contacts in their closed position.
Figure 12:
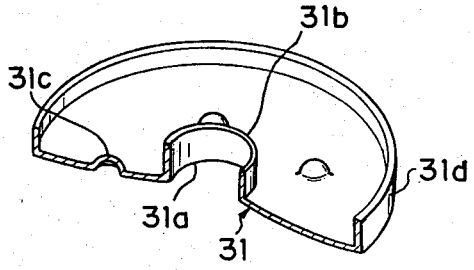
FIG. 12 shows a partially sectioned perspective view of the second metallic end plate located around the movable electrode holder shown in FIG. 10.

FIGS. 10, 11, and 12 show a fifth preferred embodiment according to the present invention. In FIG. 10, numerals 30 and 31 denote first and second metallic end plates respectively which are partially bent inwardly and made of corrosion-free copper. The first metallic end plate 30 is provided with a hole 30*a* through which the stationary electrode holder 34 is inserted and to which the holder 24 is brazed as indicated by numeral 21, a plurality of elongated radial recesses 30*b* at a given angular distance from each other, and a lip 30*c* protruding inward from the periphery portion thereof to extend into the circular groove 25*a* of the insulating envelope 25 so as to be brazed therewith.

Similarly, the second metallic end plate 31 is provided with a hole 31*a* at the center thereof through which the movable electrode holder 16 is inserted so as to be able to move in its axial direction, a lip 31*b* bent inward from the hole 31*a* at the end of which the lower end of the bellows 17 is brazed, a plurality of relatively small recesses 31*c* at a given angular distance from each other to which the lower end of the arc shielding member 20 is brazed, and a lip 31*d* along the periphery which is bent inward to fit into the circular groove 25*b* to be brazed to the metallized portion 25c. In the vacuum interrupter VI each end plate 30 and 31 is bent toward the inside of the vacuum vessel at the edge 31d so that the strength of each end plate 30 and 31 increases. The other constructions, actions, and manufacturing methods are substantially the same as those in the other preferred embodiments.

Figure 13:
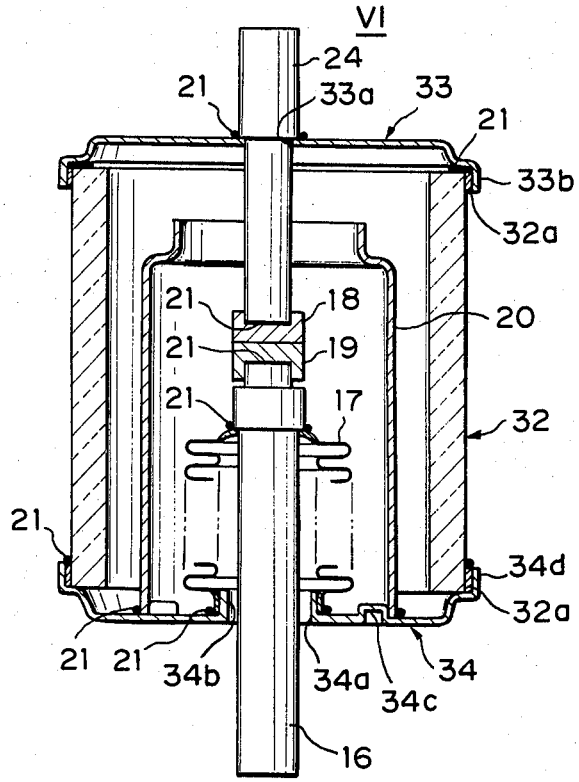
FIG. 13 shows an axial cross-sectional view of a vacuum interrupter of a sixth preferred embodiment in accordance with the principles of the present invention with the electrode contacts in their closed position.

FIG. 13 shows a sixth preferred embodiment according to the present invention. In FIG. 13, numeral 32 denotes an insulating envelope made of ceramics or crystallized glass at the outer peripheral surface of each end of which a metallized layer 32a is formed. Numerals 33 and 34 denote first and second metallic end plates made of corrosion-free copper, respectively. The first end plate 33 is provided with a hole 33a at the center thereof through which the stationary electrode holder 24 is inserted and to which it is brazed and a lip 33b bent slightly toward the outer peripheral surface of the insulating envelope 32 and to be brazed to the metallized layer 32a. Similarly, the second metallic end plate 34 is provided with a hole 34a at the center thereof through which the movable electrode holder 16 is inserted so as to be able to move in its axial direction, a lip 34b bent inward from the hole 34a at the upper end of which the bellows 17 is brazed, a plurality of recesses 34c at a given angular distance from each other so as to be brazed to the lower end of the arc shielding member 20, and a lip 34d bent upward to be brazed to the metallized layer 32a provided on the peripheral surface of the lower end of the insulating envelope 32. In this vacuum interrupter, a compression force is applied to the insulating envelope 32 due to the contraction of each end plate 33 and 34 after brazing. The ceramics material used in the insulating envelope 32 has, in particular, a larger strength against a compression force so that the vacuum interrupter VI is constructed as described above.

Figure 14:
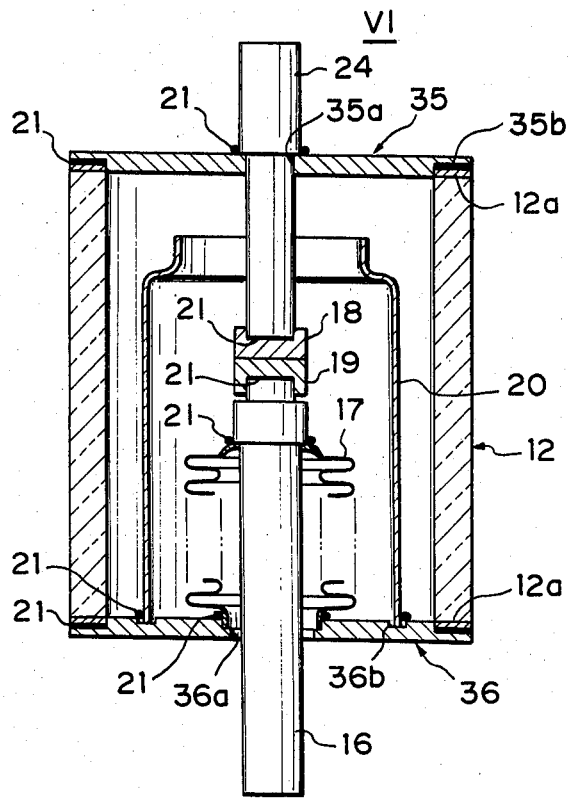
FIG. 14 shows an axial cross-sectional view of a vacuum interrupter of a seventh preferred embodiment in accordance with the principles of the present invention with the electrode contacts in their closed position.
Figure 15:
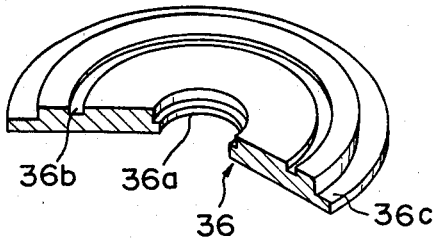
FIG. 15 shows a partially sectioned perspective view of the second metallic end plate located around the movable electrode holder of the vacuum interrupter shown in FIG. 14.

FIGS. 14 and 15 show a seventh preferred embodiment according to the present invention. In FIG. 14, numerals 35 and 36 denote first and second metallic end plates which are substantially flat discs made of corrosion-free copper, respectively. The first end plate 35 is provided with a hole 35a at the centre thereof through which the stationary electrode holder 24 is inserted and to which the holder 24 is brazed, and a flange 35b at the periphery thereof to which the metallized layer 12a of the insulating envelope 12 is brazed. On the other hand, the second metallic end plate 36 is provided with a hole 36a with at least one step through which the movable electrode holder 16 is inserted so as to be able to move in its axial direction and to which the lower end of the bellows 17 is brazed, a circular groove 36b provided coaxially with the hole 36a into which the lower end of the arc shielding member 20 is inserted and brazed to the lower end thereof, and a flange 36c at the periphery thereof to which the metallized layer 12a of the insulating envelope 12 is brazed. The first and second end plates 35 and 36 are formed by pressing or cutting. In this vacuum interrupter, both end plates 35 and 36 have so thick a wall that a sufficient strength can be provided without particular convex and concave indentations in either of the end plates 35 and 36. The other constructions, actions, and manufacturing methods are substantially the same as those in the preferred embodiments described above.

Figure 16:
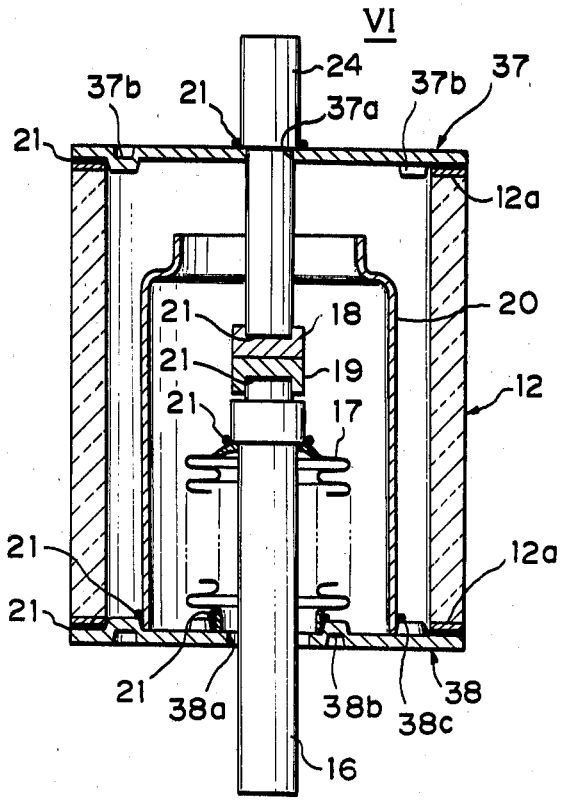
FIG. 16 shows an axial cross-sectional view of a vacuum interrupter of an eighth preferred embodiment in accordance with the principles of the present invention with the electrode contacts in their closed position.
Figure 17:
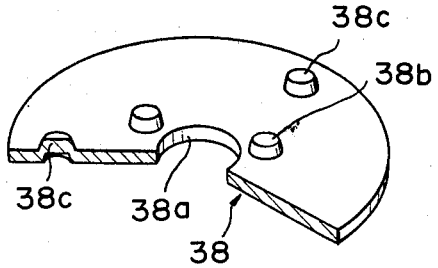
FIG. 17 shows a partially sectioned perspective view of the second metallic end plate located around the movable electrode holder shown in FIG. 16.

FIGS. 16 and 17 show a eighth preferred embodiment according to the present invention. In FIG. 16, numerals 37 and 38 denote first and second metallic end plates of relatively flat thick disks made of corrosion-free copper, respectively. The first metallic end plate 37 is provided with a hole 37a through which the stationary electrode holder 24 is inserted and to which the holder 24 is brazed as indicated by numeral 21, and a plurality of recesses 37b at the periphery thereof with which the internal end surface of the insulating envelope 12 is engaged. Similarly, the second metallic end plate 38 is provided with a hole 38a at the centre thereof through which the movable electrode holder 16 is inserted so as to be able to move in its axial direction, a plurality of recesses 38b near the hole 38a to which the lower end of the bellows 17 is brazed, and a plurality of recesses 38c along the periphery thereof to which the arc shielding member 20 is brazed. In this vacuum interrupter each end plate 37 and 38 is considerably thicker so that only relatively small diameter recesses 37b, 38b, and 38c need by provided. The other constructions, actions, and manufacturing methods are substantially the same as those in the other preferred embodiments described above.

Figure 18:
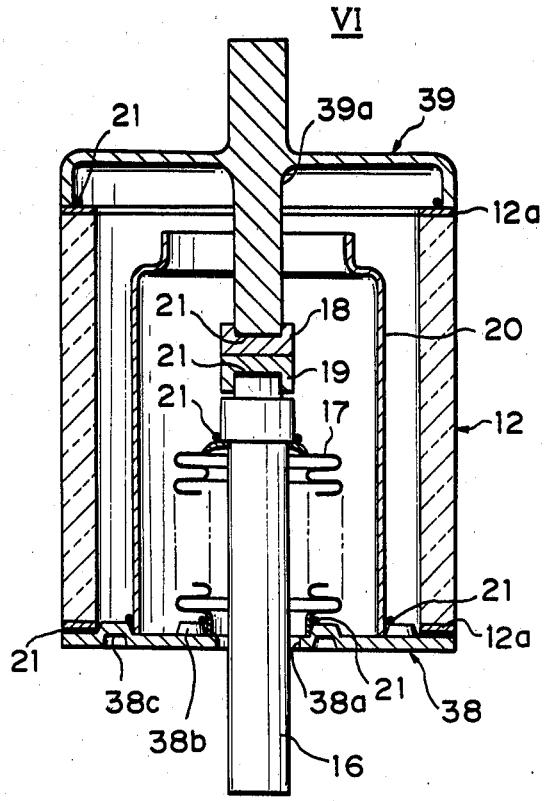
FIG. 18 shows an axial cross-sectional view of a vacuum interrupter of a ninth preferred embodiment in accordance with the principles of the present invention with the electrode contacts in their closed position.

FIG. 18 shows a ninth preferred embodiment according to the present invention. In FIG. 18, numeral 39 denotes a stationary end plate having an integrally formed stationary electrode holder 39a made of corrosion-free copper. Since there is no need to braze the stationary electrode holder 39a to the stationary end plate 39 the number of brazed joints are thereby reduced.

Figure 19:
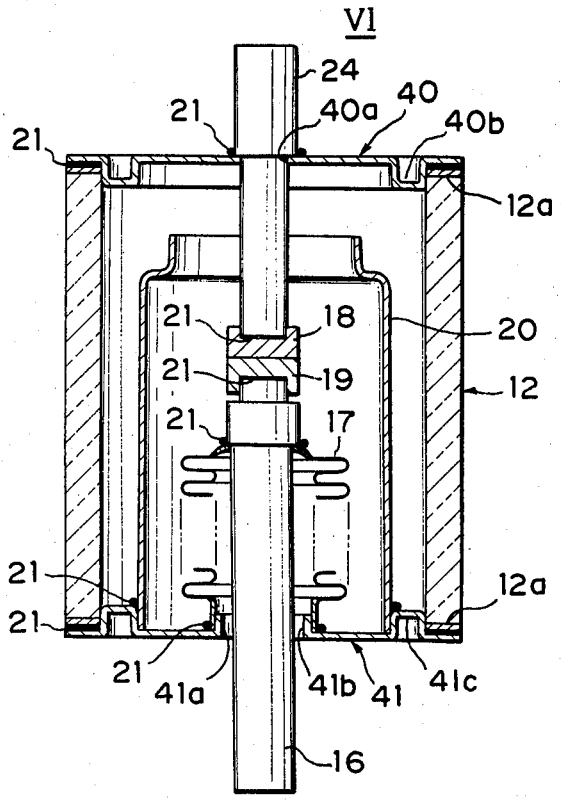
FIG. 19 shows an axial cross-sectional view of a vacuum interrupter of a tenth preferred embodiment in accordance with the principles of the present invention with the electrode contacts in their closed position.
Figure 20:
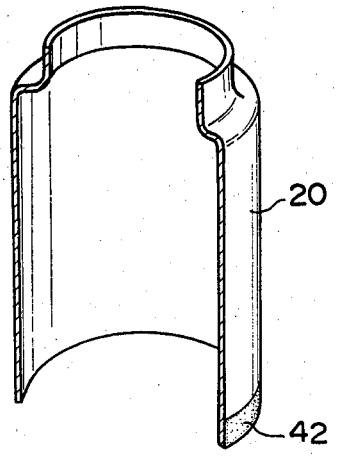
FIG. 20 shows a sectioned perspective view of the arc shielding member of the vacuum interrupter of the tenth preferred embodiment shown in FIG. 19.
Figure 21:
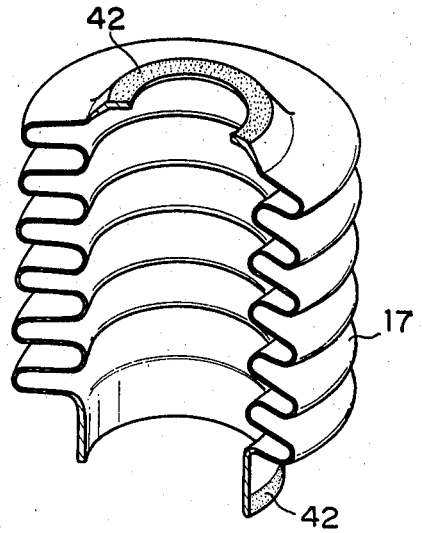
FIG. 21 shows a sectioned perspective view of the bellows of the vacuum interrupter of the tenth preferred embodiment shown in FIG. 19.

FIGS. 19 to 21 show a tenth preferred embodiment according to the present invention. In FIG. 19, numerals 40 and 41 denote first and second metallic end plates made of corrosion-free copper. The first end plate 40 is provided with a hole 40a at the center thereof through which the stationary electrode holder 40 is inserted and to which the holder 40 is brazed as indicated by numeral 21, and a circular recess 40b at the periphery thereof to which the inner surface of the upper end of the insulating envelope 12 is brazed. Similarly, the second metallic end plate 41 is provided with a hole 41a at the center thereof through which the movable electrode holder 16 is inserted so as to be able to move in its axial direction, a lip 41b around the hole 41a to which the lower end of the bellows 17 is brazed, and another circular recess 41c around the periphery thereof at the inner edge of which the lower end of the arc shielding member 20 is brazed and to the outer edge of which the lower end of the insulating envelope 12 is attached. When this vacuum interrupter VI is manufactured, the ends of the bellows 17 to be brazed and those of the arc shielding member 20 made of Fe-Cr alloy and having a high brazing temperature must be sintered after nickel plating 42 as is shown in FIGS. 20 and 21 and all the parts to be brazed at 21 are at a temperature ranging from 600° C. to 900° C. and under a vacuum pressure below $10^{-4}$ Torr.

Figure 22:
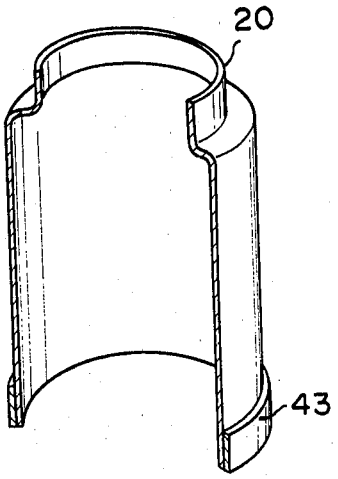
FIG. 22 shows a sectioned perspective view of the arc shielding member of a vacuum interrupter of an eleventh preferred embodiment in accordance with the principles of the present invention.
Figure 23:
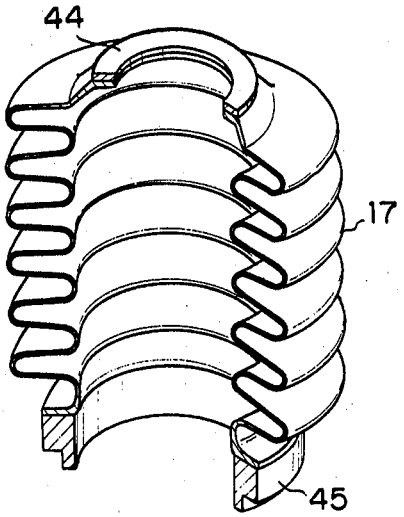
FIG. 23 shows a sectioned perspective view of the bellows of a vacuum interrupter of the eleventh preferred embodiment in accordance with the present invention.

FIGS. 22 and 23 show a eleventh preferred embodiment according to the present invention. In this embodiment, the ends of the bellows 17 and arc shielding member 20 are to be brazed are previously brazed with an auxiliary brazing metal made of copper at a temperature ranging from 900° C. to 1050° C. and under a vacuum pressure below $10^{-4}$ Torr. After the brazing operation described above, the brazing of the ends of the bellows 17 and arc shielding member 20 with other corresponding members of the vacuum interrupter VI is carried out at a temperature ranging from 600° C. to 900° C. and under a vacuum pressure below $10^{-4}$ Torr.

Figure 24:
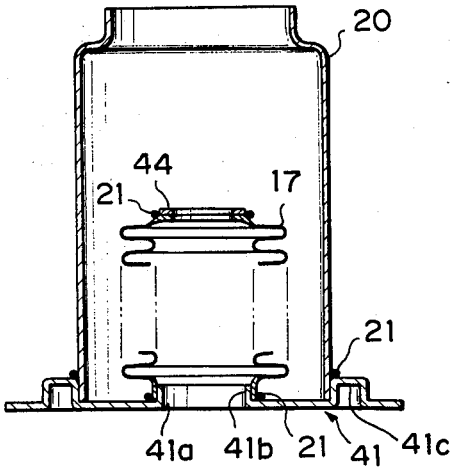
FIG. 24 shows an axial cross-sectional view of part of a vacuum interrupter of a twelfth preferred embodiment in accordance with the present invention particularly indicating the brazing position for a single brazing operation.

FIG. 24 shows a twelfth preferred embodiment according to the present invention. In this embodiment, the brazing of the lower ends of the bellows 17 and the arc shielding member 20 to the corresponding surfaces of the second end plate 41 and the other end of the bellows 17 with a brazing auxiliary member 44 is carried out at a temperature ranging from 900° C. to 1050° C. and under a vacuum pressure below $10^{-4}$ Torr. After the brazing operation described above, the brazing of the other members to the corresponding members described above as indicated also by numeral 21 is carried out at a temperature ranging from 600° C. to 900° C. and under a vacuum pressure below $10^{-4}$ Torr.

As described hereinbefore in the vacum interrupter according to the present invention each end plate is made of copper so that the brazing of each end plate with other corresponding members can be carried out at a temperature ranging from 600° C. to 1050° C. and under a vacuum pressure below $10^{-4}$ Torr in a hydrogen atmosphere using an arbitrary brazing metal since cracks do not develop in a copper member using a brazing metal including silver. In addition, copper is a nonmagnetic material, so that a large eddy current is not generated due to magnetic flux caused by a flowing current and, therefore, the consequent rise in temperature does not appear in the end plates. It will, therefore, be appreciated that it is advantageous to use end plates made of copper instead of a Fe-Cr alloy in the vacuum interrupter. Furthermore, each end plate made of copper is easily shaped by means of pressing and is less expensive then if made of a Fe-Ni or Fe-ni-Co alloy. Although end plates made of copper have a considerably different thermal expansion coefficient from that of the insulating envelope made of ceramic or crystallized glass, such end plates are easily deformed due to the annealing treatment during brazing. Therefore, thermal stress generated between the end plate and insulating envelope is absorbed by the plastic deformation of each end plate so that the insulating envelope and the brazed joints will not be broken. Furthermore, the annealed copper is transformed from plastic deformation to elastic deformation when the temperature of the annealed copper drops below 200° C. after brazing. At this time, each end plate exhibits a hardened state so that each end plate increases its mechanical strength and can withstand the impact generated when the vacuum interrupter is opened or closed.

It will be understood by those skilled in the art that the foregoing description is in terms of preferred embodiments of the present invention wherein various changes and modifications may be made without departing from the spirit and scope of the present invention, which is to be defined by the appended claims.

What is claimed is:

1. A vacuum interrupter for electric power having a vacuum vessel, the vacuum vessel comprising:

(a) a cylindrical insulating envelope made of a ceramic materials or crystallized glass having a metallized layer at each end thereof;

(b) a first metallic end plate made of copper located on one end of said cylindrical insulating envelope;

(c) a second metallic end plate made of copper located on the other end of said cylindrical insulating envelope;

(d) a stationary electrode holder fixedly extending through said first metallic end plate, at the inner end of which a stationary electrode contact is provided;

(e) a movable electrode holder extending through said second metallic end plate so as to be able to move in a given direction at the inner end of which a movable electrode contact is provided;

(f) an arc shielding member located within said cylindrical insulating envelope so as to surround said stationary and movable electrode contacts;

(g) a bellows located within said arc shielding member for movably sealing said movable electrode holder with said second metallic end plate; and (h) means for connecting said first metallic end plate with one metallized layer of said cylindrical insulating envelope, connecting said second metallic end plate with the other metallized layer of said cylindrical insulating envelope, connecting said first metallic end plate with said stationary electrode holder, and connecting one end each of said arc shielding member and bellows with said second metallic end plate.

2. A vacuum interrupter as set forth in claim 1, wherein said connecting means comprises a brazing metal including silver.

3. A vacuum interruputer as set forth in claim 1 or 2, wherein said stationary electrode holder is made of copper and said connecting means hermetically brazes said first metallic end plate with said stationary electrode holder and with one metallized layer of said cylindrical insulating envelope and brazes said second metallic end plate with the other metallized layer of said cylindrical insulating envelope both at a temperature ranging from 600° C. to 1050° C. and under a vacuum pressure below $10^{-4}$ Torr.

4. A vacuum interrupter as set forth in claim 1 or 2, wherein each metallized layer is provided on each end surface of said cylindrical insulating envelope and said connecting means brazes a periphery adjacent a circular recess of each of said first and second metallic end plates with the corresponding metallized layer of said cylindrical insulating envelope.

5. A vacuum interrupter as set forth in claim 1 or 2, wherein said connecting means brazes the peripheral portion adjacent to a plurality of recesses with a given angular distance between one another of each of said first and second metallic end plates with the corresponding metallized portion of said cylindrical insulating envelope.

6. A vacuum interrupter as set forth in claim 1 or 2, wherein each metallized layer is provided in a circular groove on each end surface of said cylindrical insulating envelope and said connecting means brazes each peripheral edge bent at substantially right angle of said first and second metallic end plates with the corresponding metallized layer of said cylindrical insulating envelope.

7. A vacuum interrupter as set forth in claim 6, wherein said connecting means brazes said arc shielding member with said second metallic end plate and brazes said bellows with said second metallic end plate at each edge portion of a circular recess provided at said second metallic end plate.

8. A vacuum interrupter as set forth in claim 6, wherein said first and second metallic end plates are provided with a step between central and peripheral portions thereof.

9. A vacuum interrupter as set forth in claim 6, wherein said first metallic end plate is provided with a plurality of elongated recesses with a given angular distance from one another between central and peripheral portions thereof.

10. A vacuum interrupter as set forth in claim 1, wherein said stationary electrode holder is integrally formed with said first metallic end plate.

11. A vacuum interrupter as set forth in claim 1, wherein both ends of said arc shielding member and bellows and made of an iron and chromium alloy and are previously brazed with an auxiliary brazing metal of copper at a temperature ranging from 900° C. to 1050° C. and under a vacuum pressure below $10^{-4}$ Torr.

12. A vacuum interrupter for electric power having a vacuum vessel, the vacuum vessel comprising:

(a) an insulating envelope made of ceramic or crystallized glass having a metallized layer at each end thereof;

(b) a first metallic end plate made of copper on the periphery of which one metallized layer of said insulating envelope is brazed with the metallized layer of said insulating envelope sandwiched between said envelope and the first end plate periphery so as to form a hermetic seal;

(c) a second metallic end plate made of copper on the periphery of which the other metallized layer of said insulating envelope is brazed with the other metallized layer of said insulating envelope sandwiched between said envelope and the second end plate periphery so as to form a hermetic seal;

(d) a stationary electrode holder fixedly extending through said first metallic end plate and having a stationary electrode contact brazed to the inner end thereof;

(d) a movable electrode holder extending through said second metallic end plate so as to be able to move in a given direction and having a movable electrode contact brazed to the inner end thereof, said movable electrode contact being in contact with said stationary electrode contact when the vacuum interrupter is closed and separated therefrom when the vacuum interrupter is open;

(f) an arc shielding member located within the insulating envelope so as to surround said stationary and movable electrode contacts and being brazed to said second metallic end plate at one end thereof; and (g) a bellows located within said arc shielding member, brazed to said movable electrode holder at one end thereof and to said second metallic end plate at the other end thereof.

13. A vacuum interrupter as set forth in claim 12, wherein parts of said first metallic end plate are brazed to said stationary electrode holder and to the metallized layer at one end of said insulating envelope and a part of said second metallic end plate is brazed to the metallized layer of the other end of said insulating envelope at a temperature ranging from 600° C. to 1050° C. and under a vacuum pressure below $10^{-4}$ Torr.

14. A vacuum interrupter as set forth in claim 13, wherein brazing may be in a hydrogen atmosphere, a getter material for adsorbing the hydrogen being provided within the vacuum vessel.

15. A vacuum interrupter as set forth in claim 12, wherein said arc shielding member and bellows are made of a iron and chromium alloy and the stationary and movable electrode contacts are made of a copper or beryllium alloy so that all the brazing can be carried out uniformly at a temperature ranging from 900° C. to 1050° C. and under a vacuum pressure below $10^{-4}$ Torr.

16. A vacuum interrupter as set forth in claim 15, wherein the brazing of said arc shielding member and bellows to said second metallic end plate and said bellows and said movable electrode holder is performed at a temperature ranging from 900° C. to 1050° C. and under a vacuum pressure below $10^{-4}$ Torr or in a hydrogen atmosphere, and the remaining parts are brazed at a temperature ranging from 600° C. to 900° C. and under a vacuum pressure below $10^{-4}$ Torr.

17. A vacuum interrupter as set forth in claim 16, wherein each of said stationary and movable electrode contacts brazed to the ends of said stationary and movable electrode holders are made of a silver alloy.

18. A vacuum interrupter as set forth in claim 15, wherein said arc shielding member is made of copper.

19. A vacuum interrupter as set forth in claim 12, wherein said stationary electrode holder and first metallic end plate are integrally formed.

20. A vacuum interrupter as set forth in claim 12, wherein both ends of said bellows and arc shielding members both made of an iron-chromium alloy are sintered with a nickel plating so that the brazing operation between each member and the corresponding member is carried out uniformly at a temperature ranging from 600° C. to 900° C. and under a vacuum pressure below $10^{-4}$ Torr.

21. A vacuum interrupter as set forth in claim 12, wherein both ends of said arc shielding member and said bellows are made of an iron and chromium alloy are brazed with an auxiliary brazing metal of copper at a temperature ranging from 900° C. to 1050° C. and under a vacuum pressure below $10^{-4}$ Torr.

22. A vacuum interrupter as set forth in claim 12, wherein said second metallic end plate is brazed to one end of said arc shielding member and bellows which are both made of an iron and chromium alloy with an auxiliary brazing metal is brazed at a temperature ranging from 900° C. to 1050° C. under a vacuum pressure below $10^{-4}$ Torr, and said second metallic end plate is brazed to the metallized layer of said insulating envelope and the other end of said bellows is brazed to said movable electrode holder at a temperature ranging from 600° C. to 900° C. and under a vacuum pressure below $10^{-4}$ Torr.

23. A vacuum interrupter for electric power having a vacuum vessel, the vacuum vessel comprising:

(a) an insulating envelope made of ceramic or crystallized glass having a metallized layer at each end thereof;

(b) a first metallic end plate made of copper on the periphery of which one metallized layer of said insulating envelope is brazed with the metallized layer of said insulating envelope sandwiched between said envelope and the first end plate periphery so as to form a hermetic seal;

(c) a second metallic end plate made of copper on the periphery of which the other metallized layer of said insulating envelope is brazed with the metallized layer of said insulating layer sandwiched between said envelope and the second plate periphery so as to form a hermetic seal;

(d) a stationary electrode holder fixedly extending through said first metallic end plate and having a stationary electrode contact brazed to the inner end thereof;

(e) a movable electrode holder extending through said second metallic end plate so as to be able to move in a given direction and having a movable electrode contact brazed to the inner end thereof, said movable electrode contact being in contact with said stationary electrode contact when the vacuum interrupter is closed and separated therefrom when the vacuum interrupter is open;

(f) an arc shielding member located within said insulating envelope so as to surround said stationary and novable electrode contacts and being brazed to said second metallic end plate at one end thereof;

(g) a bellows located within said arc shielding member, brazed to said movable electrode holder at one end thereof and to said second metallic end plate at the other end thereof; and (h) said first metallic end plate being provided with first means at the center thereof for inserting and brazing said stationary electrode holder and second means at the periphery thereof for brazing to the metallized layer of one end of said insulating envelope, and said second metallic end plate being provided with third means at the center thereof for inserting said movable electrode holder to be able to move in a given direction, fourth means along said third means for brazing to one end of said bellows, fifth means along said fourth means for brazing to one end of said arc shielding member, and sixth means along the periphery of said second metallic plate for brazing to the metallized layer of said insulating envelope.

24. A vacuum interrupter as set forth in claim 23, wherein said first and second metallic end plates are provided with a plurality of radial recesses at a given angular distance from each other so as to form said second, fifth, and sixth means, and said fourth means of said second metallic end plate is an edge protruding toward the inside of the vacuum vessel.

25. A vacuum interrupter as set forth in claim 23, wherein said second and sixth means are bent inward into a circular groove provided at each end of said insulating envelope and recesses form said second, fourth, fifth, and sixth means which are circular.

26. A vacuum interrupter as set forth in claim 23, wherein said first metallic end plate is provided with a first step between said first and second means, said second and sixth means are bent inward into a circular groove at each end of said insulating envelope and said fifth means is formed at a second step between said third and sixth means.

27. A vacuum interrupter as set forth in claim 23, wherein said first metallic end plate is provided with a plurality of elongated radial recesses between said first and second means at a given angular distance from each other, and said second metallic end plate is provided with a plurality of relatively small radial recesses at a given angular distance from each other so as to form said fifth means, said second and sixth means being bent inward into a circular groove provided at each end of said insulating envelope.

28. A vacuum interrupter as set forth in claim 23, the metallized layer of said insulating envelope is provided at each outer periphery thereof and said second and sixth means are formed with an edge so as to be brazed to the metallized layer.

29. A vacuum interrupter as set forth in claim 23, wherein said first and second metallic end plates have a relatively thick wall of substantially flat shape in section.

30. A vacuum interrupter as set forth in claim 29, wherein said third means of said second metallic end plate is a hole with a step, the step forming said fourth means, said fifth means being a circular groove, and said second means of said first metallic end plate and sixth means of said second metallic end plate are formed with flanges.

31. A vacuum interrupter as set forth in claim 29, wherein said first metallic end plate is provided with a plurality of radial recesses at a given angular distance from each other located beside said second means for engaging with said insulating envelope, and said second metallic end plate is provided with a plurality of radial recesses at a given angular distance from one another located between said fifth means and sixth means and forming said fourth means.

32. A vacuum interrupter as set forth in claim 23, wherein said first metallic end plate is further provided with seventh means along said first means for receiving said stationary electrode holder, and said first and third means of said first and second metallic end plates are holes, respectively, said second, fourth, fifth and sixth means are formed each with a recessed edge, and said stationary electrode holder has a flange for fitting and brazing to said seventh means.

33. A vacuum interrupter for electric power having a vacuum vessel, the vacuum vessel comprising:

(a) a cylindrical insulating envelope made of ceramic or crystallized glass having a metallized layer at each end thereof;

(b) a first metallic end plate made of copper located on one end of said cylindrical insulating envelope;

(c) a second metallic end plate made of copper located on the other end of said cylindrical insulating envelope;

(d) a stationary electrode holder fixedly extending through said first metallic end plate, at the inner end of which a stationary electrode contact is provided;

(e) a movable electrode holder extending through said second metallic end plate so as to be able to move in a given direction at the inner end of which a movable electrode contact is provided;

(f) an arc shielding member located within said cylindrical insulating envelope so as to surround said stationary and movable electrode contacts;

(g) a bellows located within said arc shielding member for movably sealing said movable electrode holder with said second metallic end plate;

(h) means for connecting said first metallic end plate with one metallized layer of said cylindrical insulating envelope, connecting said second metallic end plate with the other metallized layer of said cylindrical insulating envelope, connecting said first metallic end plate with said stationary electrode holder, and connecting one end each of said arc shielding member and bellows with said second metallic end plate;

(i) said and second metallic end plates being substantially thick each having a flange at the peripheral portion and said connecting means hermetically brazes the flange of each of said first and second metallic end plates with the corresponding metallized layer of said cylindrical insulating envelope;

(j) said second metallic end plate being provided with a plurality of relatively small recesses with an angular distance from one another at the near center thereof brazed to one end of said bellows and other relatively small recesses with an angular distance from one another at the periphery portion thereof brazed to one end of said arc shielding member.

* * * * *